United States Patent [19]

Furusawa

[11] 4,383,156

[45] May 10, 1983

[54] CONTROL CIRCUIT FOR CONTROLLING A MAGNETRON OF A MICROWAVE OVEN

[75] Inventor: Takashi Furusawa, Nara, Japan

[73] Assignee: Sharp Kabushiki Kaisha, Osaka, Japan

[21] Appl. No.: 926,395

[22] Filed: Jul. 20, 1978

[30] Foreign Application Priority Data

Jul. 25, 1977 [JP] Japan ..... 52-99701[U]

[51] Int. Cl.[3] ..... H05B 6/68

[52] U.S. Cl. ..... 219/10.55 B; 219/10.55 C

[58] Field of Search ..... 219/10.55 B, 10.55 C; 361/160, 166

[56] References Cited

U.S. PATENT DOCUMENTS 3,932,723 1/1976 Tamano et al. ..... 219/10.55 B 4,054,802 10/1977 Mock ..... 361/160

*Primary Examiner*—B. A. Reynolds

*Assistant Examiner*—Philip H. Leung

*Attorney, Agent, or Firm*—Birch, Stewart, Kolasch & Birch

[57] ABSTRACT

A control circuit for energizing a magnetron of a microwave oven includes only one switching element for controlling the energization of a primary winding of a high voltage transformer connected to the magnetron resulting in the power supply conducted from a power source to the primary winding. The switching element comprises a triac connected to the primary winding or a relay switch for controlling power supply from a power source to the primary winding. The relay switch can be energized by a Large Scale Integrated Circuit which controls the energization of the magnetron in accordance with a program introduced therein through a manual control.

12 Claims, 3 Drawing Figures

CONTROL CIRCUIT FOR CONTROLLING A MAGNETRON OF A MICROWAVE OVEN

BACKGROUND OF THE INVENTION

1. Field of the Invention

The present invention relates to a microwave oven and, more particularly, to a control circuit for controlling a magnetron of a microwave oven with simplicity.

2. Description of the Prior Art

Recently, it has been known to provide a control system for a microwave oven, including a programmable digital logic control circuit which enables a user to program information into the digital logic control circuit. A large scale integrated circuit such as a semiconductor chip is necessarily required within the digital logic control circuit. An example of such a control system is shown in Fosnough et al U.S. Pat. No. 4,011,428 issued Mar. 8, 1977, entitled "MICROWAVE OVEN TIMED AND CONTROL CIRCUIT".

A further example of a control system for a magnetron related to the programmable digital logic control circuit was disclosed in the copending U.S. Pat. No. 4,149,056 assigned to the same assignee, patented Apr. 10, 1979, entitled "MICROWAVE OVEN WITH FOOD TEMPERATURE-SENSING MEANS", the disclosure of which is incorporated herein by reference. The corresponding Canadian patent application is Ser. No. 277,750, filed May 5, 1977.

The following is a circuit configuration of the control system described in the above U.S. Pat. No. 4,149,056.

FIG. 1 shows the circuit construction of a microwave oven including a control unit 80 employing a food temperature control of a food to be cooked. The circuit mainly comprises the control unit 80, a slipping connector 81, a temperature-sensing probe 82, a triac 83, and a microwave generator including a magnetron 84. The control unit 80 includes control circuitry of large scale integrated circuit 91 etc. Two relays 92, 93 are operated by the large scale integrated circuit 91 to control a current flow of a gate line 85 and a cook relay 94, respectively. The relay 92 is provided for switching the power supply and the relay 93 is provided for controlling the magnetron energy with ON-OFF switching through the actuation of a switch 106 connected to the triac 83.

A temperature signal detected by the temperature-sensing probe 82 is introduced into the control unit 80 via the slipping connector 81, said unit 80 functioning to control a predetermined cooking temperature of the food which is positioned in the microwave oven.

A gate signal through the gate line 85 developed from the control unit 80 triggers the triac 83 to control the microwave energy of the magnetron 84, said signal corresponding to the predetermined food temperature selected by a control panel. The triac 83 with a varistor 87 as a protective device controls a current flow to a primary winding of a high voltage transformer 86 connected to a winding of a heater transformer 88, said transformer 86 being connected to the magnetron 84 via capacitor 89 and a rectifier 90 for activating the magnetron 84, and said transformer 88 being connected to a filament of the magnetron 84. A power supply side includes a commertial power source 95, and a monitor switch 96 which is mechanically placed in its OFF condition when a latch door is closed and is mechanically placed in its ON condition when the latch door is opened. The power supply side further includes a primary interlock switch 97 and a secondary interlock switch 98, which are mechanically placed in the ON condition when the latch door is closed and are mechanically placed in the OFF condition when the latch door is opened through the use of the latch mechanism. That is, the interlock switches 97 and 98 function to allow the power supply to the remaining portions of the circuit only when the latch door is tightly closed.

A timer for cooking is set at a desired value through the use of a plurality of touch keys included within the control panel. When a coil of a cook relay 100 is energized by the relay 92 which is closed by a start switch 99 on the control panel, the energization is held and functions to close relay contacts 101 and 102. The coil of the cook relay 100 functions to close the relay contact 102 which provides a current path to an oven light 105 and to close the relay contact 101 which provides a current path to the high voltage transformer 86. A fan motor FM for driving a fan blade to draw cooling air through the base of the microwave oven cavity and the turntable motor TTM are further enabled.

A stop switch 103 on the control panel is activated by a latch of the latch door. When a open lever provided on the latch door is operated, the stop switch 103 opens, and the cook relay 100 is opened, which in turn, opens the cook relay contacts 101 and 102 to cut off current flow to the oven light 105 and the high voltage transformer 86. When a memory start switch 104 is activated to recall information in a memory bank, a memorized program in a memory-bank is conducted.

To energize intermittently the magnetron 84, the triac 83 shall control the energization of the magnetron 84 and the relay contact 101 select cooking time for the food by controlling the power supply to the primary winding of the heater transformer 88 and the high voltage transformer 86. The relay contact 101 is positioned in a pathway connected to the high voltage transformer 86 in addition to the fan motor FM, the turntable motor TTM, and the heater transformer 88. Therefore, the relay contact 101 must be resistant to a high voltage and large current. This results in the necessity of supplying the cook relay 100 with a large voltage and current for the activation of the relay contact 101. Therefore, the additional relay 92 shall be provided and energized in accordance with a small voltage and current developed from the large scale integrated circuit 91.

The following are exemplary values of the voltage and the current at the respective elements.

(i) The input of the relay 92 (namely, the output of a driver (not shown) of the large scale integrated circuit 91): 12 V, 30 mA.

(ii) The output of the relay 92 for energizing a switch connected to the cook relay 100: 120 V, 0.5 mA.

(iii) The enabling magnitude for switching the relay contact 101: 120 V, 11 A.

The relay 93, on the other hand, has the values of the voltage and current for energizing the switch 106 as follows.

(i) The input of the relay 93 (namely, the output of the driver for the large scale integrated circuit 91): 12 V, 30 mA.

(ii) The output of the relay 93: 120 V, 0.5 A.

SUMMARY OF THE INVENTION

In view of the foregoing, it is a primary object of the present invention to provide an improved control circuit for a magnetron of a microwave oven.

More particularly, it is another object of the present invention to provide a simplified control circuit of a microwave oven, said control circuit including only one switching element for controlling the energization of a primary winding of a high voltage transformer connected to the magnetron.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a first circuit including a triac and a primary winding of a high voltage transformer connected to the magnetron is paralleled to a second circuit including a primary winding of a heater transformer connected to the magnetron and a relay contact connected to the primary winding of the heater transformer. A terminal of the primary winding of the high voltage transformer is connected to a power supply at a side opposite to itself in conjunction with the relay contact activated by a cook relay. Therefore, the magnetron is controlled by only one switching element such as the triac irrespective of the activation of the relay contact.

In another type of the magnetron which has no specific primary winding of the heater transformer and, therefore, no triac to control the energization of the magnetron, a first circuit including the primary winding of the high voltage transformer and the relay contact is paralleled to a second circuit including a turntable motor and a fan motor. The first circuit is parallel to a second circuit including the cook relay which individually activates the relay contact. The only relay contact controls the energization of the magnetron through switching power supply from the primary winding to the high voltage transformer.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
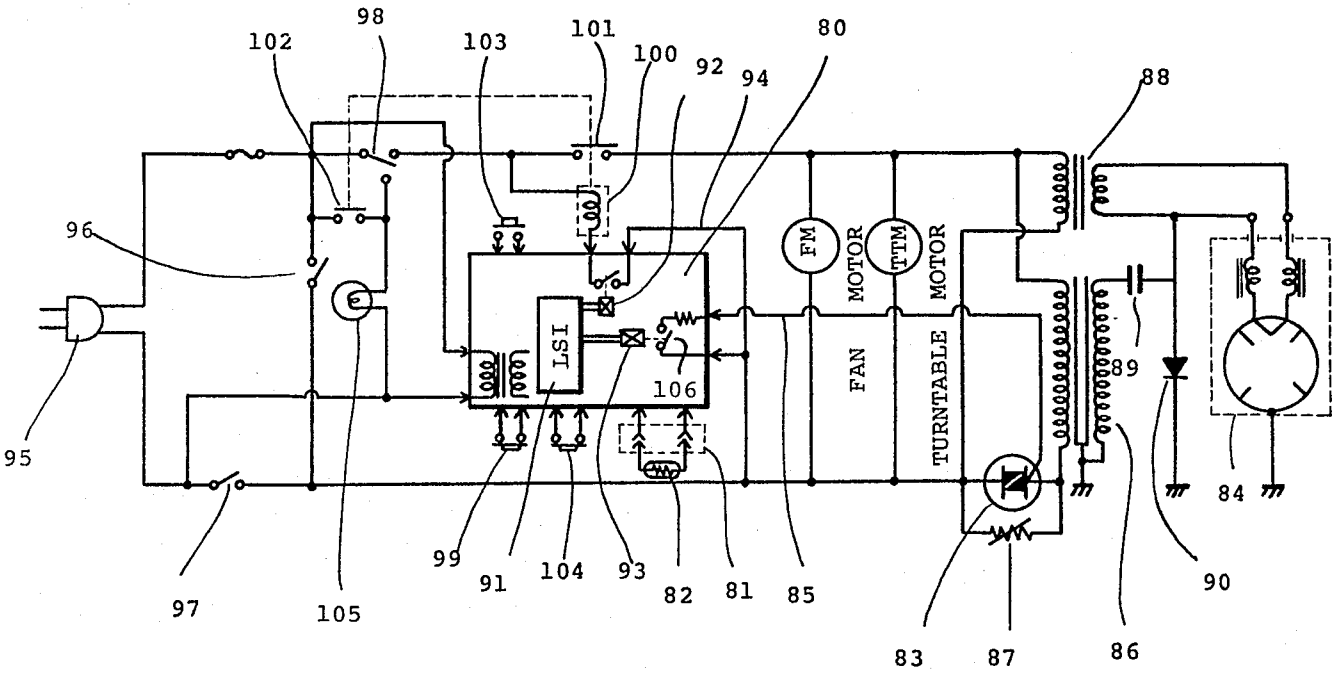
FIG. 1 PRIOR ART
FIG. 1 is a circuit configuration of the prior art control circuit for a magnetron of a microwave oven.
Figure 2:
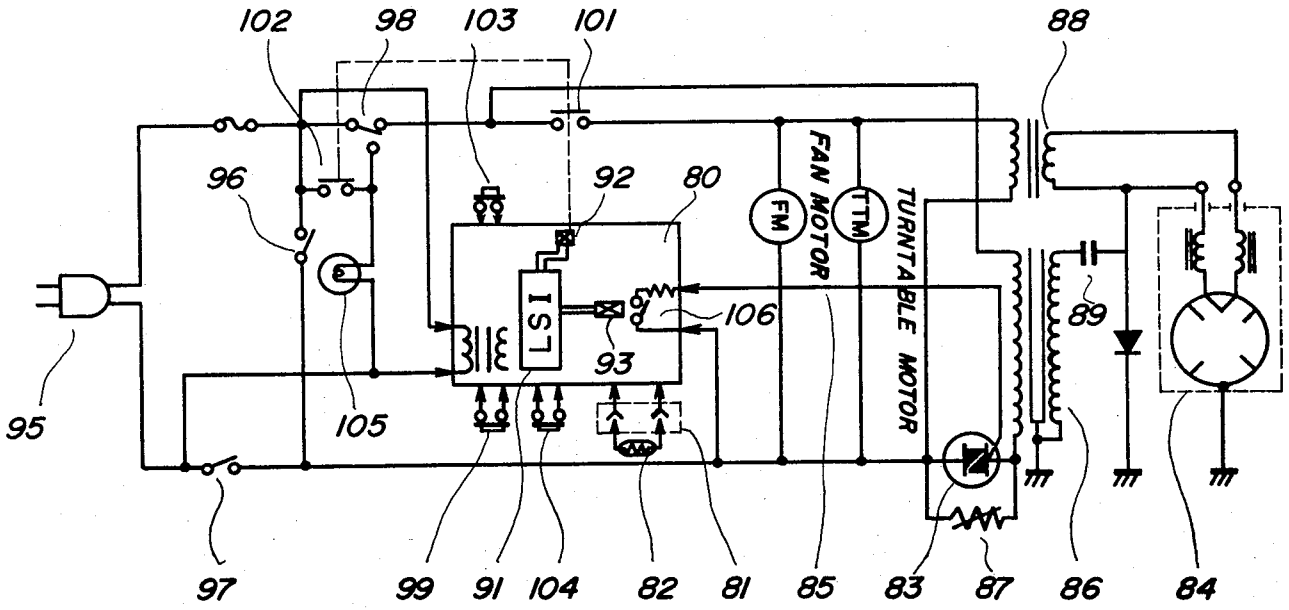
FIGS. 2 and 3 are circuit configurations of control circuits for magnetrons of microwave ovens according to the present invention.

FIG. 2 illustrates a control circuit according to the present invention. Like elements corresponding to those of FIG. 1 are indicated by like numerals.

A first line including the triac 83 and the primary winding of the high voltage transformer 86 connected to the magnetron 84 is parallel with a second line including the primary winding of the heater transformer 88 connected to the magnetron 84 and the relay contact 101. A terminal of the primary winding of the high voltage transformer is coupled to a power supply at a side opposite to itself in conjunction with the relay contact 101. Therefore, the relay contact 101 has no relation to current introduced into the primary winding of the high voltage transformer 86. This results in the relay contact 101 with a low voltage and a small current. The relay 92 which energizes the relay contact 101 can be activated directly through a driver (not shown) of the large scale integrated circuit 91. The relay 92 can function as the cook relay 100 shown in FIG. 1.

In FIG. 1, the two relays 92 and 93 require lower power for energization purposes. In contrast, the cook relay 100 and the triac 83 require higher power for energization purposes. In FIG. 2, on the other hand, two relays 92 and 93 require lower power as well for energization purposes. On the contrary, the triac 83 requires higher power as well for energization purposes.

The following is exemplary values of the voltage and the current at the respective elements.

(i) The input of the relay (namely, the output of the driver of the large scale integrated circuit 91): 12 V, 75 mA.

(ii) The magnitude for energizing the relay contact 101: 120 V, 5 A.

(iii) The input of the relay 93 (namely, the output of the driver of the large scale integrated circuit 91): 12 V, 30 mA.

(iv) The magnitude for energizing the switch 106: 120 V, 0.5 A.

The driver of the large scale integrated circuit 91 can develop a current not more than 400 mA.

With this arrangement, the relay 92 can be energized directly by the driver of the large scale integrated circuit 91.

The energization of the primary winding of the high voltage transformer 86 is controlled only by the triac 83 while the power supply is conducted. The relay 92 keeps closing the cook relay contacts 101 and 102 until the programmed cooking time elapses. At that time, the magnetron 84 is controlled only by the switching of the triac 83.

Even if the triac 83 is damaged to thereby consistently energize the high voltage transformer 86, the heater transformer 88 can be controlled by the relay contact 101, whereby the magnetron 84 must not remain energized. In other words, the magnetron 84 is prevented from being erroneously energized by the triac 83 because the activation of the heater transformer 88 is controlled by the relay contact 101.

Figure 3:
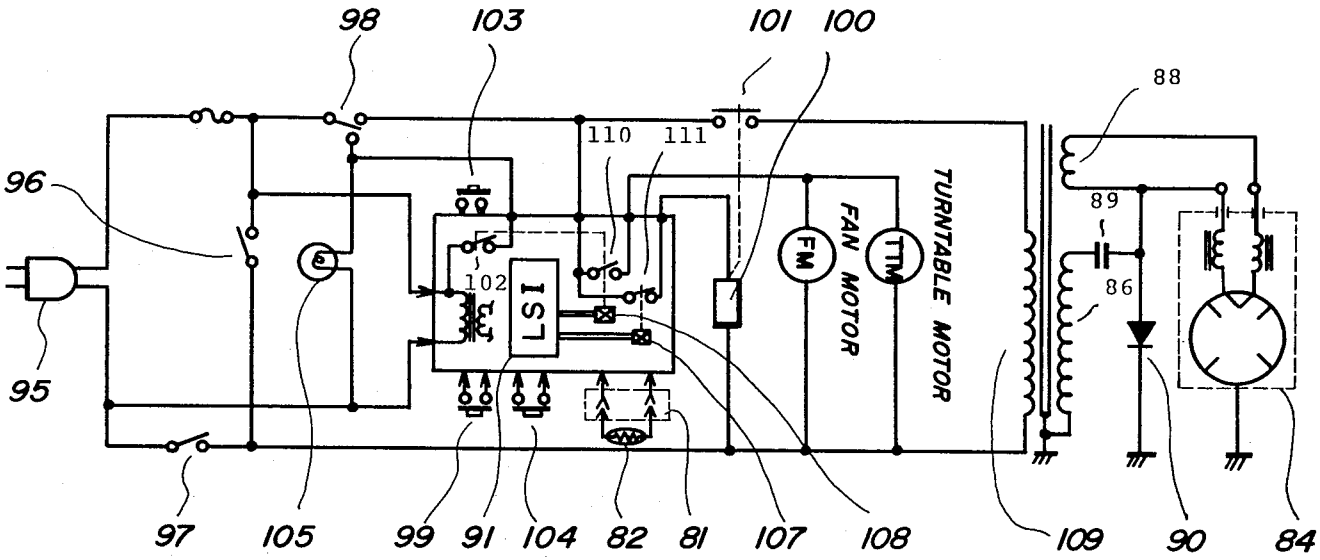

FIG. 3 shows another specific control circuit according to present invention. Like element corresponding to those of FIG. 2 are indicated by like numerals.

In FIG. 3, two small relays 107 and 108 are provided for energizing respective relay contacts 110 and 111, respectively. The relay contact 110 is coupled to the fan motor FM and the turntable motor TTM. The relay contact 111 is related to the cook relay 100. A primary winding 109 is related to both the high voltage transformer 86 and the heater transformer 88 connected to the magnetron 84. The primary winding 109 is connected to the relay contact 101. With this circuit configuration, the triac 83 illustrated in FIG. 2 can be eliminated.

The energization of the primary winding 109 is only controlled by the relay contact 101 through the cook relay 100 while the power supply is conducted. The following is the exemplary magnitude of the voltage and the current at the respective elements.

(i) The input of the relay 107 (namely, the output of the driver of the large scale integrated circuit 91): 12 V, 30 mA.

(ii) The output of the same (namely, the terminals of the relay contact 111): 120 V, 0.5 A.

(iii) The input of the relay 108 (namely, the output of the driver): 12 V, 30 mA.

(iv) The output of the same (namely, the terminals of the relay contact 110): 120 V, 5 A.

(v) The output of the Large Scale Integrated Circuit 91: 15 V, 0.8 mA.

(vi) The power of the cook relay 100: 1 W, 10 mA.

(vii) The terminals of the cook relay contact 101: 125 V, 11 A.

As apparently noted from the above, the control circuit of FIG. 3 comprises two small relays 107 and 108, and only one great powerful cook relay 100.

This arrangement prevents the magnetron 84 form being erroneously energized by the power supply in accordance with a specific circuit element. However, the cook relay 100 has satisfactory responsibility for the protecting purposes.

While only certain embodiments of the present invention have been described, it will be apparent to those skilled in the art that various changes and modifications may be made therein without departing from the spirit and scope of the invention as claimed.

What is claimed is:

1. A power control circuit for energizing a microwave oven magnetron having a pair of bias terminals and a filament, said control circuit further comprising:

high voltage transformer means having a primary winding and a secondary winding connected to said magnetron bias terminals;

control switching means for applying power to said magnetron, said control switching means having a pair of power terminals directly connected to a power source and said primary winding, said control switching means having a third control terminal;

logic means including a drive circuit having an output, the output of said drive circuit being connected to only the control terminal of said control switching means to control the power applied to said magnetron bias terminals, said drive circuit output being the only control signal used to control the application of power to said magnetron bias terminals;

a heating transformer having an input winding and an output winding connected to said magnetron filament; and filament relay switch means directly responsive to an output of said logic means for controlling the application of power to said magnetron filament mutually independent to the application of power to said magnetron bias terminals by said control switching means.

2. The control circuit according to claim 1, wherein said control switching means comprises a triac connected to said primary winding.

3. The control circuit according to claim 1, wherein said control switching means comprises a relay switch for controlling power supplied from a power source to said primary winding.

4. The control circuit of claim 1 wherein said logic means is a Large Scale Integrated Circuit which controls the power application to said bias terminals and said filament of said magnetron in accordance with an operator predetermined program.

5. The control circuit of claim 1 wherein said triac and said high voltage transformer primary winding are arranged in series on a first line;

wherein said filament relay switch and said heating transformer input winding are arranged in series on a second line; and wherein said first line is in parallel with second line.

6. The control circuit of claim 1 wherein said filament may be controlled separately from said magnetron bias terminals.

7. The control circuit of claim 5 wherein said second line includes a fan motor and a turntable motor connected in parallel with said heating transformer input winding; and wherein said magnetron bias terminals may be controlled separately from the parallel connection of said heating transformer input winding, for motor, and turntable motor.

8. A power control circuit for energizing a magnetron of a microwave oven, comprising:

magnetron energization control means for applying a bias voltage to said magnetron, said magnetron energization control means having a pair of power terminals directly connected to a source of power and said magnetron;

first logic means including a first drive circuit having an output, the output of said first drive circuit being connected to only said magnetron energization control means to control the bias voltage applied to said magnetron, said first drive circuit output being the only control signal used to control the bias voltage of said magnetron;

auxiliary motor means for performing a secondary function in said microwave oven; and second logic means including a second drive circuit having an output, the output of said second drive circuit being connected to said auxiliary motor means for applying power thereto separately from the energization of said magnetron.

9. The power control circuit of claim 8 wherein said auxiliary motor means is a fan motor.

10. The power control circuit of claim 8 wherein said auxiliary motor means is a turntable motor.

11. The power control circuit of claim 8 wherein said magnetron energization control means comprises a relay.

12. The power control circuit of claim 8 wherein said magnetron energization control means comprises a triac.

* * * * *